US007090596B2

(12) United States Patent
David

(10) Patent No.: US 7,090,596 B2
(45) Date of Patent: Aug. 15, 2006

(54) SPORT TRAINING AND GAME DEVICE

(76) Inventor: Larry David, 3800 W. Latonka Rd., Littleton, CO (US) 80123

( * ) Notice: Subject to any disclaimer, the term of this patent is extended or adjusted under 35 U.S.C. 154(b) by 0 days.

(21) Appl. No.: 10/686,080

(22) Filed: Oct. 15, 2003

(65) Prior Publication Data

US 2005/0082762 A1 Apr. 21, 2005

(51) Int. Cl.
*A63B 69/00* (2006.01)

(52) U.S. Cl. ..... 473/439; 273/402

(58) Field of Classification Search ..... 273/398–402, 273/406, 407; 473/438, 439, 446, 470, 471, 473/476, 477, 478
See application file for complete search history.

(56) References Cited

U.S. PATENT DOCUMENTS

| | | | | |
|---|---|---|---|---|
| 1,529,893 | A * | 3/1925 | Kastner | 273/343 |
| 3,860,862 | A * | 1/1975 | Dell et al. | 318/568.1 |
| 4,079,939 | A * | 3/1978 | Raistakka | 273/402 |
| 4,188,031 | A * | 2/1980 | Fox | 473/454 |
| 4,295,648 | A * | 10/1981 | Stromback | 473/456 |
| 4,565,527 | A * | 1/1986 | Burchett | 434/248 |
| 4,718,668 | A * | 1/1988 | Schipske | 473/462 |
| 4,826,166 | A * | 5/1989 | Baker et al. | 473/439 |
| 4,905,996 | A * | 3/1990 | Tallent et al. | 473/197 |
| 4,936,578 | A * | 6/1990 | Hudson, Sr. | 473/439 |
| 5,280,904 | A * | 1/1994 | Rodriguez | 473/477 |
| 6,024,659 | A * | 2/2000 | Reed | 473/477 |
| 6,220,976 | B1 * | 4/2001 | Kaiser et al. | 473/476 |
| 6,375,585 | B1 * | 4/2002 | Driscoll | 473/477 |
| 6,394,917 | B1 * | 5/2002 | Chiappini et al. | 473/415 |
| 6,402,641 | B1 * | 6/2002 | Lee | 473/446 |
| 6,544,132 | B1 * | 4/2003 | Tvedt | 473/448 |
| 6,620,065 | B1 * | 9/2003 | Clabough | 473/454 |
| 6,808,175 | B1 * | 10/2004 | Gleeson | 273/343 |
| 2003/0144091 | A1 * | 7/2003 | Dickson | 473/477 |
| 2003/0199342 | A1 * | 10/2003 | Birss | 473/446 |
| 2004/0132557 | A1 * | 7/2004 | Broglio et al. | 473/422 |

* cited by examiner

*Primary Examiner*—Mark S. Graham
(74) *Attorney, Agent, or Firm*—John L. Isaac

(57) ABSTRACT

A device is disclosed which includes a base and a pair of substantially vertical members supported by the base. A horizontal member extends substantially horizontally between the vertical members. A first mechanism selectively adjusts the vertical position of the horizontal member, while a second mechanism selectively adjusts the horizontal position of the vertical members to define a first projectile target area. A target loop is mounted to the horizontal member within the first projectile target area and defines a second projectile target area. A third mechanism is provided for selectively adjusting the position of the target loop along the horizontal member between the vertical members. Finally, an arm extension attaches the target loop to the horizontal member and includes a fourth mechanism for variably adjusting the distance between the target loop and the horizontal member within the first projectile target area.

26 Claims, 6 Drawing Sheets

SPORT TRAINING AND GAME DEVICE

BACKGROUND OF THE INVENTION

1. Field of the Invention

The present invention relates generally to sport training and game playing devices utilizing an airborne projectile and, more particularly, to a device wherein one or more individuals may either play a game or practice skills in a sport using a projectile such as a football, baseball, Frisbee and the like. Specifically, the present invention relates to a football training or playing system wherein an individual may practice throwing and kicking skills individually or by interacting with other participants.

2. Description of the Prior Art

The use of recreational games and various practice devices relating to a wide variety of different sports is well known. The game devices are designed for recreational amusement and tend to mimic some of the movements of well-known sports. Examples of such devices are illustrated in U.S. Pat. No. 3,312,471, No. 4,592,555 and No. 6,338,686 wherein known movements from basketball and/or football are combined with other movements to provide recreational amusement devices.

Other devices and assemblies are designed not to necessarily provide amusement, but rather to provide a practice device for one or more sport movements. For example, U.S. Pat. No. 6,544,132 provides a device to improve basketball-shooting skills, U.S. Pat. No. 4,948,147 provides a device to improve soccer kicking skills, while U.S. Pat. No. 4,068,846 provides a device to help practice and improve football-kicking skills. U.S. Pat. No. 3,908,992, No. 6,220,976, No. 6,375,585 and No. 6,394,917 all provide different types of football goal post devices designed to enhance one's football kicking skills. In addition, U.S. Pat. No. 3,820,787, No. 4,168,066, No. 4,826,166, No. 4,936,578, No. 5,037,095 and No. 6,620,065 are all designed to enable a person to practice and thereby enhance their football passing skill. U.S. Pat. No. 3,680,862 provides a target device that is designed to enable a person to practice both football passing and kicking skills as well as football hiking skills.

While the above devices enable a person to achieve a desired end purpose of either a skill practice or recreational amusement, none of them combine both sport skill practice with a game device designed for recreational amusement. Moreover, all of the above devices are designed for use by one participant. Unfortunately, many of the above mentioned sport skills involve two or more parties participating interactivity in the real world of sports, and none of the above devices address this issue. For example, the act of football passing requires that the ball actually be received by a target, not just thrown along a particular path, and the target is oftentimes moving. None of the above devices address this issue. Therefore, there remains a need in the art for such a device, and the present invention addresses and solves this particular problem in the art.

SUMMARY OF THE INVENTION

Accordingly, it is one object of the present invention to provide a sport game and practice device that enables a person to mimic and practice a sport movement or skill while also providing a game for amusement.

It is another object of the present invention to provide a device that enables a person to mimic and practice a sport skill generally requiring airborne projectiles that include the use of a multifaceted adjustable target.

Yet another object of the present invention is to provide such a device that allows more than one person to participate in using the device and enables the target to be moving.

Still another object of the present invention is to provide an improved method for improving sport skills while simultaneously providing a recreational game for amusement.

To achieve the foregoing and other objects and in accordance with the purpose of the present invention, as embodied and broadly described herein, a device is disclosed for use by one or more individuals for practicing and playing a sporting activity requiring the use of a projectile. The device includes a base and a pair of substantially vertical members supported by the base. A horizontal member is associated with the vertical members and extends substantially horizontally therebetween. A first mechanism is provided for selectively adjusting the vertical position of the horizontal member relative to the vertical members. A second mechanism is also provided for selectively adjusting the horizontal position of the vertical members relative to the length of the horizontal member to define a first projectile target area for the throwing or kicking of a projectile therethrough by one of the individuals utilizing the device. A target loop is mounted to the horizontal member within the first projectile target area and defines a second projectile target area for the throwing or kicking of a projectile therethrough by one of the individuals utilizing the device. A third mechanism is then provided for selectively adjusting the position of the target loop along the horizontal member between the vertical members. Finally, an arm extension attaches the target loop to the horizontal member and includes a fourth mechanism for variably adjusting the distance between the target loop and the horizontal member within the first projectile target area.

In one modification of the invention, the horizontal member is a cross bar interengaging the vertical members. In another modification, the first adjustment mechanism is in the form of a pair of attachment pins interengaging an aperture disposed in each end of the horizontal member and one of a plurality of apertures disposed in each of the vertical members. Additionally, the second adjustment mechanism may be in the form of a pair of attachment pins interengaging an aperture disposed in each of the vertical members and one of a plurality of apertures disposed in each end of the horizontal member.

Another modification of the invention includes a third adjustment mechanism in the form of an attachment pin interengaging an aperture disposed in the arm extension and one of a plurality of apertures disposed along the length of the horizontal member, while the fourth mechanism is in the form of an elongated attachment pin projecting from said arm extension and a plurality of compression clips disposed along the length of the attachment pin.

In yet another modification of the invention, the first and second adjustment mechanisms are the same while third and fourth adjustment mechanisms are also the same.

In an alternate form of the present invention, the vertical members of the device selectively project above the horizontal member to further define the first target area. One modification of this form of the invention includes each vertical member being in the form of a pair of tubular elements telescopically interconnected to enable variable length adjustment thereof.

In still another modification of the invention, the fourth adjustment mechanism of the device further provides angular adjustment of the plane defined by the second target area relative to the plane defined by the horizontal member. Alternatively, the target loop is in the form of an annular member disposed above the horizontal member and defines an enclosed target opening for the passage of the projectiles.

Another modification of the present invention includes the base in the form of a pair of stand assemblies each supporting one of the upright members on a ground surface. Moreover, the device may further include a target assembly having a support structure and a netting carried by the support structure for receiving a projectile passing through the projectile target area of the device. In one form of this modification, the target assembly is selectively movable and securable to a ground surface to provide diverse practice and training activity for individuals utilizing the device. Additionally, the support structure of the target assembly may be adjustable in height and width to provide a selectively variable target window, the netting carried by the adjustable support structure being of sufficient size and shape to cover the variable sized target window.

Alternatively, the present invention is a football training and gaming device for use by one or more individuals for practicing and playing football passing and kicking. The device includes a base and a pair of vertical upright members supported by the base. A cross bar engages the upright members and extends substantially horizontally therebetween. A first coupling mechanism is provided for selectively adjusting the vertical position of the cross bar relative to the upright members as well as for selectively adjusting the horizontal position of the upright members relative to the length of the cross bar. The cross bar and upright members define a first target area for the passing or kicking of a football by one of the individuals utilizing the device. A target loop is provided and defines a second target area for the passing or kicking of a football by one of the individuals utilizing the device, the target loop being mountable to the cross bar within the first target area. Finally, an arm element attaches the target loop to the cross bar and includes a second coupling mechanism for both variably adjusting the distance between the target loop and the cross bar within the first target area, as well as for selectively adjusting the position of the target loop along the cross bar between the upright members.

Finally, a method is provided for playing and practicing a sport which requires the use of a projectile and one or more participants. The method of the invention includes establishing a football goal post-like device having a pair of adjustable upright elements and a cross bar therebetween to define a first projectile target area. A target loop member is then provided on the cross bar to define a second, smaller projectile target area within the first projectile target area. A projectile is then moved through the first projectile area and, hopefully, the second projectile area to a target positioned on the opposite side of the target projectile areas to both practice and play the sport.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE EXEMPLARY EMBODIMENTS

Figure 1:
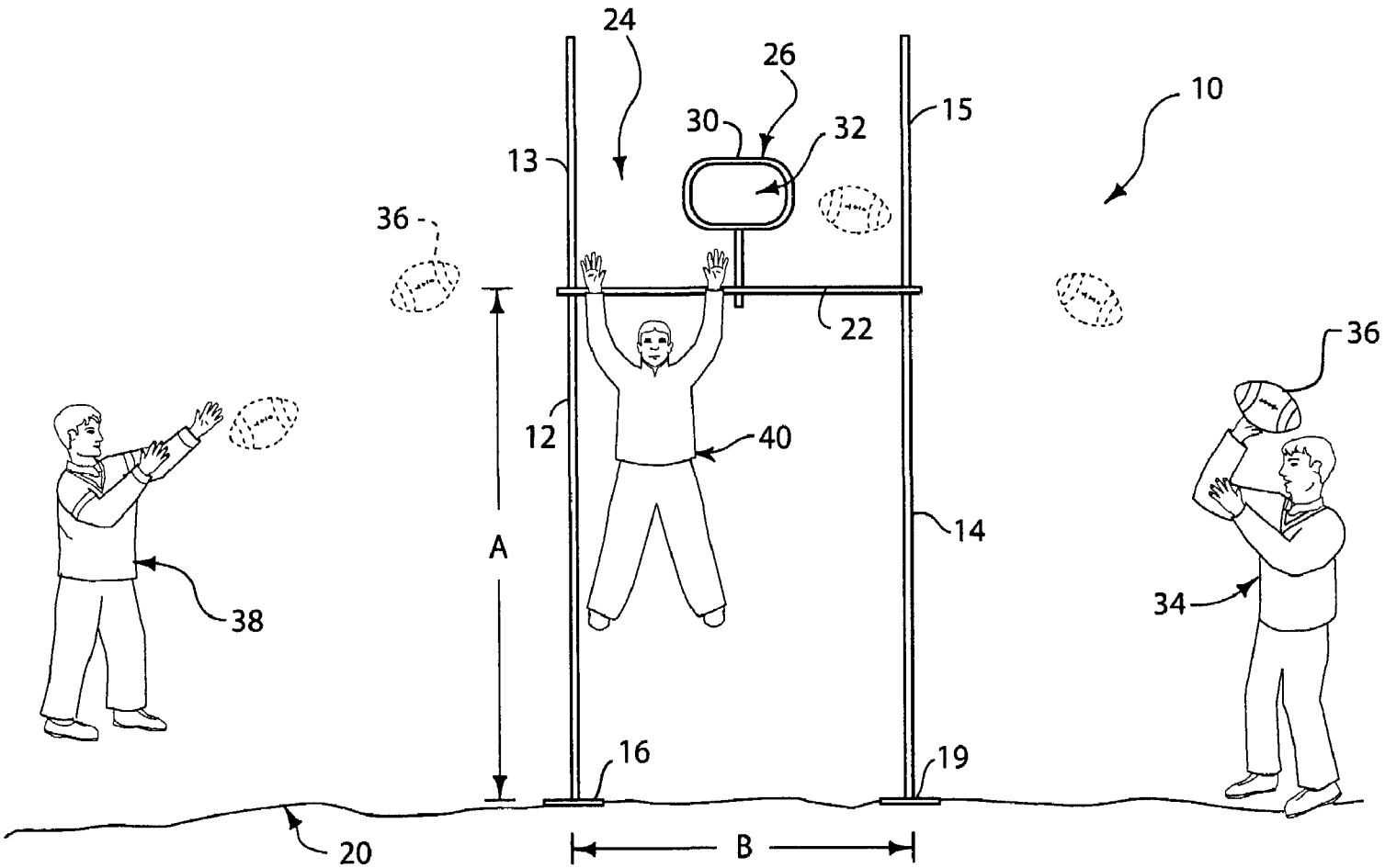
FIG. 1 is a perspective of an embodiment constructed in accordance with the present invention and illustrating participants utilizing the device.

Referring first to FIG. 1, a device 10 is provided for both practicing a sport as well as playing a recreational amusement game. While the illustrated and preferred sport is football, it should be understood that the device 10 of the invention may be used with any type of sport that incorporates the use of airborne projectiles, such as baseball, tennis, Frisbee, soccer and the like. In preferred form, the device 10 includes a pair of substantially vertical upright members 12, 14 which are supported on a base assembly in the form of a pair of base stands 16, 18. It should be understood that the base assembly may be in any desired form which permits the upright members 12, 14 to be positioned in a substantially vertical orientation on a ground surface 20.

A horizontal member 22 in the preferred form of a cross bar is secured between the upright members 12, 14. The cross bar 22 is variably attached to the uprights 12, 14 so that it may be adjusted vertically along the uprights 12, 14 to vary the distance "A" between the cross bar 22 and the ground surface 20. In addition, the vertical upright members 12, 14 are adjustably attached to the cross bar 22 so that the distance "B" may be varied for the reason discussed below. It should be understood that the uprights 12, 14 are preferably vertically extended at 13, 15 above the cross bar 22 so as to create a first target area 24 defined by the open area between the cross bar 22 and the upright extensions 13, 15.

In preferred form, a target loop 26 is attached to the cross bar 22 by an arm extension 28. The target loop 26 is preferably formed by an annular member 30 to define a second target area 32 which is positioned within the first target area 24. The arm extension 28 is preferably adjustably attached along the cross bar 22 so that the target loop may be positioned at any desired location along the cross bar 22. Moreover, the arm extension 28 is also adjustably attached so that the target loop 26 may be adjusted vertically relative to the position of the cross bar 22. In addition, the angular position of the target loop 26 relative to the plane defined by the cross bar 22 and the uprights 12, 14 may be adjusted to vary the angle of attack of a football as it passes through the target loop 26. While it is preferred that the structural components of the device 10, i.e. the uprights 12, 14, the cross bar 22, the annular member 30 and the arm extension 28, are made from light weight polyvinyl plastic and the like, any appropriate material including stainless steel, aluminum and the like, may be used.

The variable adjustments between the upright members 12, 14, the cross bar 22, the target loop 26 and the arm extension 28 all permit the dimensions "A" and "B" to be changed to vary the size and shape of the first target area 24 as well as to vary the placement of the second target area 32 within the first target area 24. In this manner, the device 10 may be used by a first individual 34 to practice passing a football 36 through the first and second target areas 24, 32. By varying the dimensions of "A" and "B" and the angle of attack at the target loop 26, the individual 34 may practice a wide variety of passing possibilities and challenges. In addition, a second individual 38 may use the device to provide a moving receiver for passing practice to add additional difficulty to the device 10. Finally, a third individual 40 may be involved with the device 10 to convert the device 10 to a sports game wherein the individual 40 attempts to block any passes initiated by the individual passer 34. The height of the individual 40 may dictate, in part, the dimension "A". In this manner, the three individuals 34, 38 and 40 may interchange roles when using the device 10 either for passing skill practice or for use of the device 10 as a game.

Figure 2:
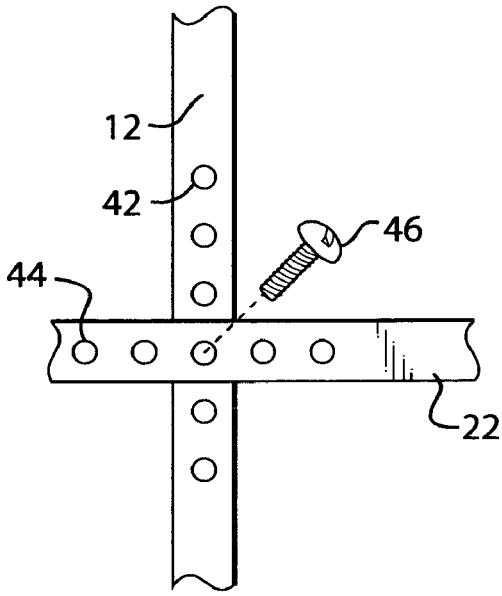
FIG. 2 is an enlarged perspective of one coupling mechanism embodiment utilized with the present invention.

In one preferred form, an adjustment coupling mechanism between the cross bar 22 and the vertical upright 12 or 14 is disclosed in FIG. 2. In this embodiment, the upright member 12 has a plurality of apertures 42 positioned along its length. Likewise, the cross bar 22 has a plurality of apertures 44 positioned along its length as well. An attachment or locking pin 46 is positioned through one selected aperture 42 and one selected aperture 44 to interlock the two members together. In this manner, the distances "A" and "B" may be adjusted by varying the apertures 42, 44 with which the pin 46 is attached. The attachment between the target loop 26. the arm extension 28 and the cross bar 22 also may use the coupling mechanism illustrated in FIG. 2.

Figure 3:
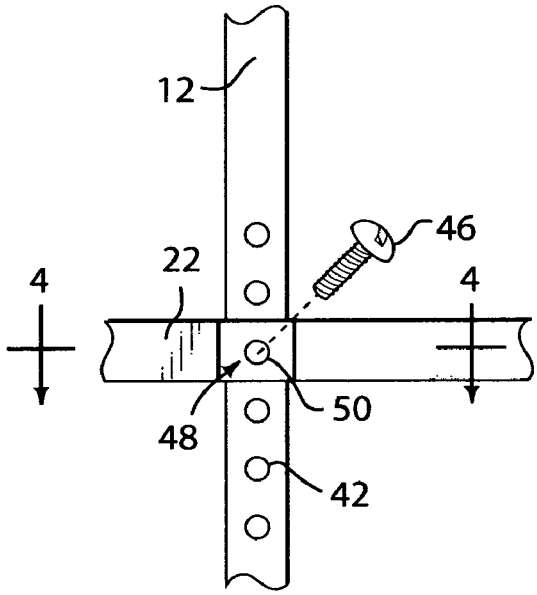
FIG. 3 is an enlarged perspective of another coupling mechanism embodiment utilized with the present invention.
Figure 4:
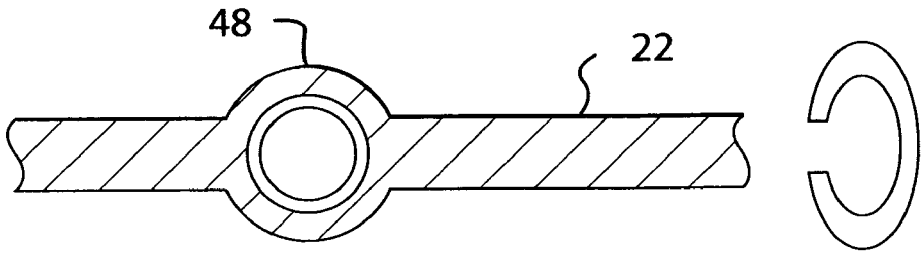
FIG. 4 is a sectional view taken substantially along Line 4—4 of FIG. 3.
Figure 5:
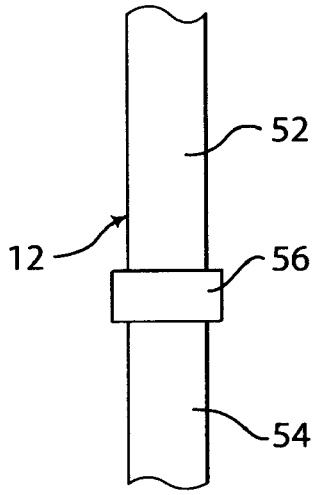
FIG. 5 is an enlarged side view of a telescoping coupling mechanism embodiment utilized with the present invention.

Another coupling mechanism that may be used to adjustably interconnect the components discussed above is illustrated in FIGS. 3 and 4. In this embodiment, the cross bar 22 includes an annular ring portion 48 that slide fits about the upright 12. The ring portion 48 includes an aperture 50 that may be connected to any selected one of the apertures 42 by the pin 46. Finally, the coupling mechanism may also be in the form of a telescoping arrangement as illustrated in FIG. 5. In this embodiment, the vertical upright 12 includes two tubular portions 52, 54 that slide fit within each other. A lock collar 56 is provided to lock the tubular portions 52, 54 together or to disengage them from each other to adjust the position of the tubular portion 52 within the portion 54.

Figure 6:
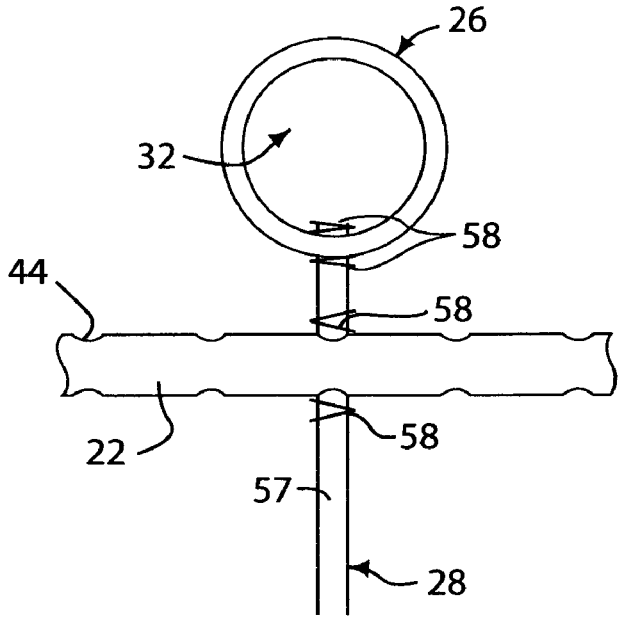
FIG. 6 is a side view of an alternate embodiment of the target loop of the present invention and its coupling mechanism to the device of the invention.

Referring to FIG. 6, an alternate embodiment for the target loop 26 is illustrated. In this embodiment, the arm extension 28 is in the form of an elongated pin 57 that is sized to fit within the apertures 22 of the cross bar 22. A plurality, and preferably four, compression or spring clips 58 are disposed on either side of the cross bar 22 and are positioned around the pin 57. The clips 58 hold the pin 57 and the associated target loop 26 in any desired position relative to the cross bar 22. Moreover, by compressing the end portions of each clip 58 toward each other, the attachment pin 57 may be moved vertically as desired.

Figure 7:
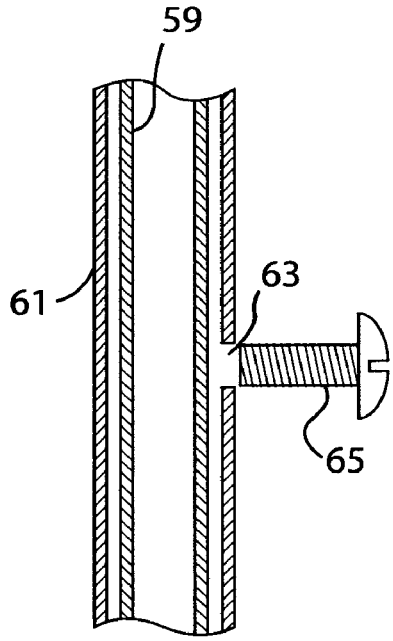
FIG. 7 is a side sectional view of a coupling mechanism embodiment utilized with the target assembly support structure of the present invention.

FIG. 7 illustrates yet another coupling mechanism useful with the present invention. In particular, the support structure of the target assembly 60 (see FIG. 8) includes an adjustability feature. This feature includes telescoping tubular arms member 59 that slidingly fits within another tubular member 61. An aperture 63 is provided, and a thumbscrew element 65 engages the aperture 63 to snugly tighten against the outer surface of the inner tubular member 59. In this manner, the telescoping members 59, 61 may be readily adjusted to whatever sized is desired. Moreover, it is preferred that the thumbscrews 65 enter from the rear of the structure so as to avoid being struck by airborne projectiles as the projectiles enter the target assembly.

Figure 8:
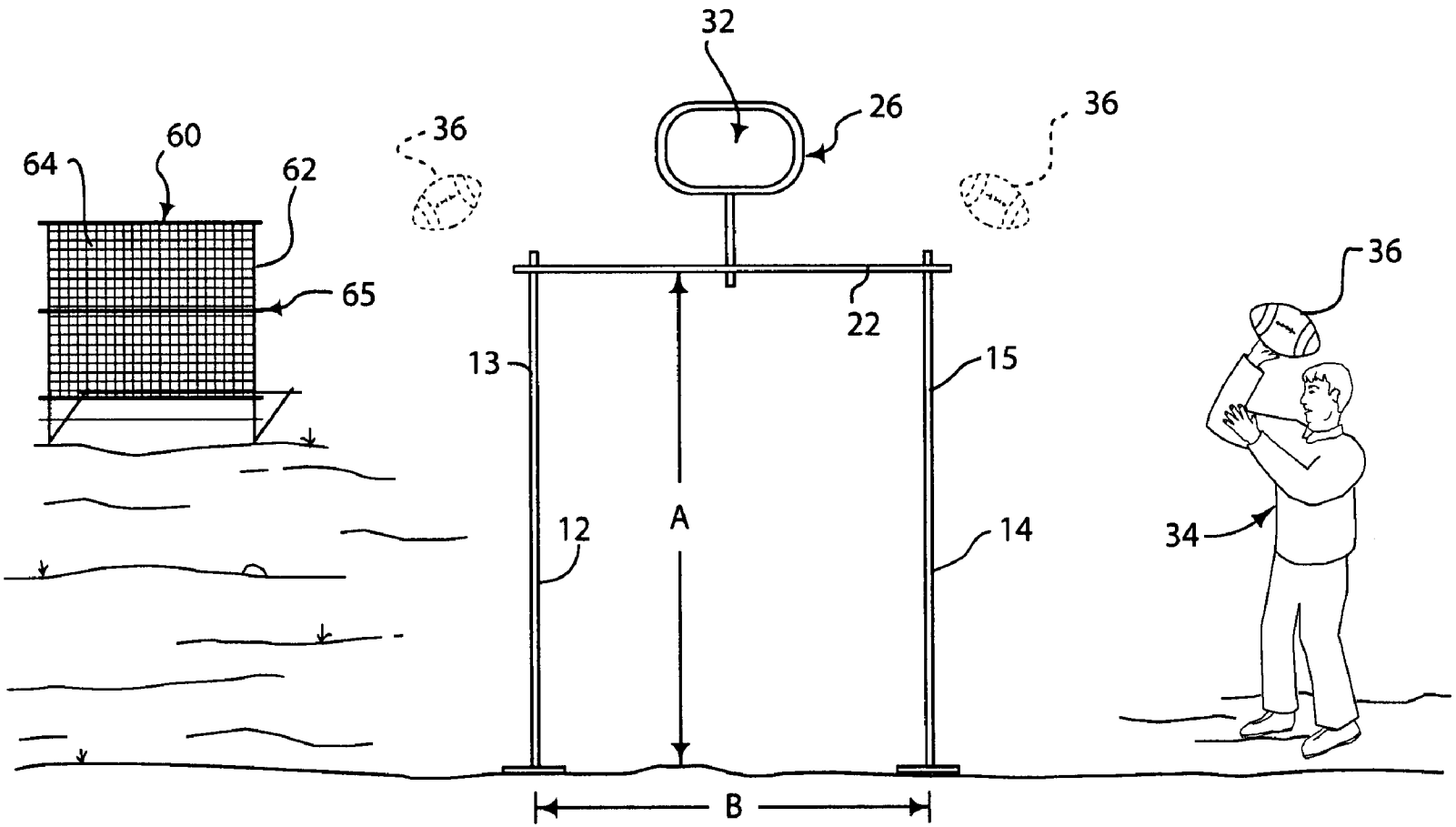
FIG. 8 is a perspective of another embodiment constructed in accordance with the present invention and illustrating a single participant utilizing the device with a target receiving member.

Referring now to FIG. 8, another embodiment of the invention is illustrated. In this embodiment, a target assembly 60 is provided and includes a frame portion 62 and a netting 64 attached to the frame portion 62. The frame portion 62 includes adjustable support elements 61, 63. These elements are size adjustable, using a plurality of compression or spring clips 58, in both height and width so that the target window of the target assembly, as defined by the size of the netting opening supported by the frame, may be varied according to the desired challenges when using the device 10. The target assembly 60 is preferably positioned on the side of the uprights 12, 14 and cross bar 22 opposite that from the individual 34 passing the football 36. In this manner, a second individual receiver 38 (FIG. 1) is not necessary for the individual 34 using the device 10 to practice passing skills through the target areas 24, 32 to a receiving unit in the form of the target assembly 60.

Figure 9:
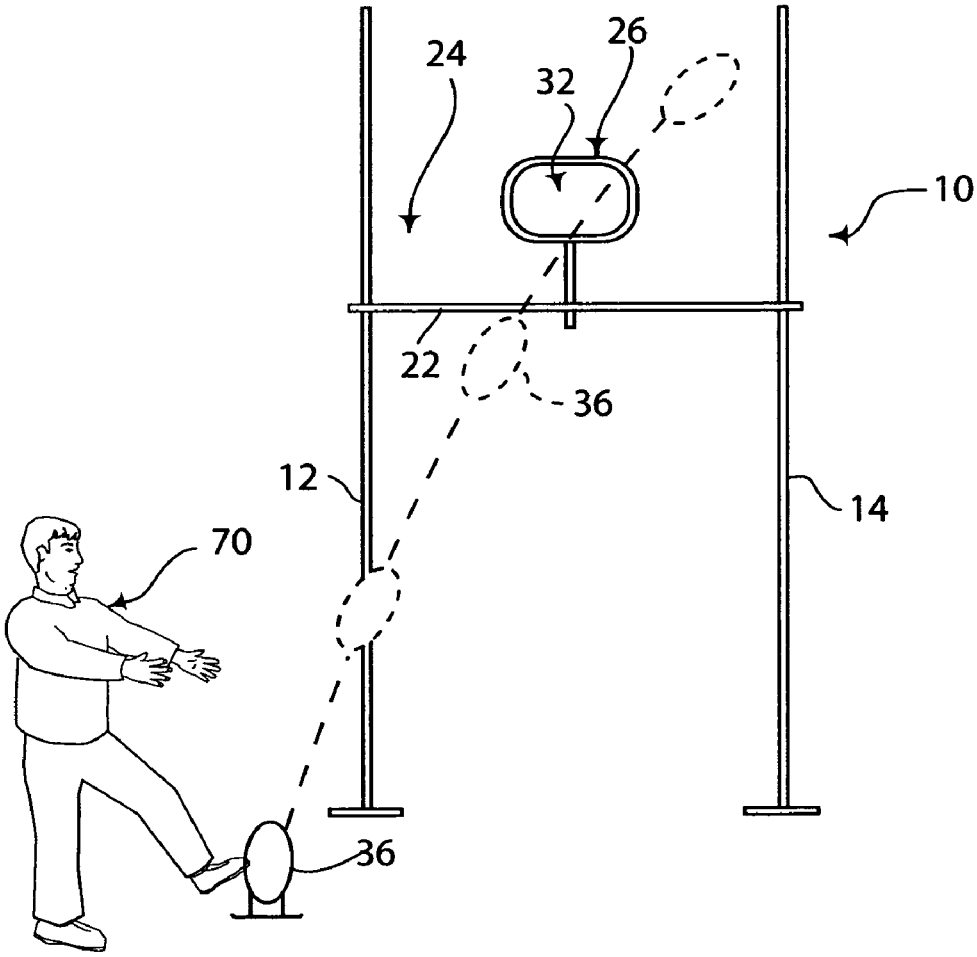
FIG. 9 is a perspective of yet another embodiment constructed in accordance with the present invention and illustrating a single participant utilizing the device of the invention for kicking practice.

Referring now to FIG. 9, the device 10 may also be utilized for kicking skill practice. An individual 70 is positioned on one side of the device 10, and the football 36 is kicked in field goal fashion through the uprights 12, 14. To add to the practice skill, the target areas 24 and 32 are provided to enhance the difficulty of the kicking game. Moreover, the second target area 32 may be adjustably positioned at any desired position along the cross bar 22 to add difficulty and challenge to both kicking practice as well as any game played with the football being kicked.

As can be seen from the above, the present invention provides a sport game and practice device that addresses many needs not filled by prior art devices. The present invention provides a single device that is both usable as a skill practice device as well as a sport game for amusement. The invention is portable and lightweight, thereby making transportation, setup and break down simple and easy. The device provides a wide variety of uses that may involve only one participant in both skill practice at throwing as well as kicking, or several participants all interacting with each other both in skill practice as well as in game participation. The present invention, although particularly suitable for the sport of football, may nonetheless be adapted for use with a wide variety of sports which utilize airborne projectiles.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A device for practicing and playing a sporting activity requiring the use of a projectile and for use by one or more individuals, said device comprising:

a base;

a pair of substantially vertical members supported by said base;

a horizontal member associated with said vertical members and extending substantially horizontally therebetween;

a first mechanism for selectively adjusting the vertical position of said horizontal member relative to said vertical members;

a second mechanism for selectively adjusting the horizontal position of said vertical members relative to the length of said horizontal member to define a first projectile target area between said horizontal and vertical members for the throwing and kicking of a projectile therethrough by one of the individuals utilizing said device;

a target loop defining a second projectile target area for the throwing and kicking of a projectile therethrough by one of the individuals utilizing said device, said target loop being mountable to said horizontal member within said first projectile target area;

a third mechanism for selectively adjusting the position of said target loop along said horizontal member between said vertical members; and an arm extension attaching said target loop to said horizontal member and including a fourth mechanism for variably adjusting the distance between said target loop and said horizontal member within said first projectile target area.

2. The device as claimed in claim 1, wherein said horizontal member comprises a cross bar interengaging said vertical members.

3. The device as claimed in claim 1, wherein said first mechanism comprises a pair of attachment pins interengaging an aperture disposed in each end of said horizontal member and one of a plurality of apertures disposed in each of said vertical members.

4. The device as claimed in claim 1, wherein said second mechanism comprises a pair of attachment pins interengaging an aperture disposed in each of said vertical members and one of a plurality of apertures disposed in each end of said horizontal member.

5. The device as claimed in claim 1, wherein said third mechanism comprises an elongated attachment pin projecting from said arm extension and one of a plurality of apertures disposed along the length of said horizontal member.

6. The device as claimed in claim 1, wherein said fourth mechanism comprises an elongated attachment pin projecting from said arm extension and a plurality of compression clips disposed along the length of said attachment pin.

7. The device as claimed in claim 1, wherein said first and second adjustment mechanisms are the same.

8. The device as claimed in claim 7, wherein said first and second adjustment mechanisms comprise a plurality of apertures disposed along the length of said horizontal member and a plurality of apertures disposed along the length of each of said vertical members, and a pair of removable attachment pins interengaging an aperture of each said vertical member and an aperture of said horizontal member.

9. The device as claimed in claim 1, wherein said third and fourth adjustment mechanisms are the same.

10. The device as claimed in claim 9, wherein said third and fourth adjustment mechanisms comprise a plurality of apertures disposed along the length of said horizontal member, and a plurality of compression clips disposed along the length of said arm extension, said arm extension being in the form of an elongated attachment pin engageable within said horizontal member apertures.

11. The device as claimed in claim 1, wherein said vertical members selectively project above said horizontal member to further define said first target area.

12. The device as claimed in claim 11, wherein each said vertical member comprises a pair of tubular elements telescopically interconnected to enable variable length adjustment thereof.

13. The device as claimed in claim 1, wherein said fourth adjustment mechanism further provides angular adjustment of the plane defined by said second target area relative to the plane defined by said horizontal and vertical members.

14. The device as claimed in claim 1, wherein said target loop comprises an annular member disposed above said horizontal member and defining an enclosed target opening for the passage of said projectiles.

15. The device as claimed in claim 1, wherein said base comprises a pair of stand assemblies each supporting one said upright member on a ground surface.

16. The device as claimed in claim 1, wherein said device further comprises a target assembly having a support structure and a netting carried by said support structure for receiving a projectile passing through said projectile target area.

17. The device as claimed in claim 16, wherein said target assembly is selectively movable and securable to a ground surface to provide diverse practice and training activity for individuals utilizing said device.

18. The device as claimed in claim 17, wherein the support structure of said target assembly is adjustable in height and width to provide a selectively variable target window, the netting carried by said adjustable support structure being of sufficient size and shape to cover the variable sized target window.

19. A football training and gaming device for use by one or more individuals for practicing and playing football passing and kicking, said device comprising:

a base;

a pair of vertical upright members supported by said base;

a cross bar engaging said upright members and extending substantially horizontally therebetween;

a first coupling mechanism for selectively adjusting the vertical position of said cross bar relative to said upright members as well as for selectively adjusting the horizontal position of said upright members relative to the length of said cross bar, said cross bar and upright members defining a first target area for the passing or kicking of a football by one of the individuals utilizing said device;

a target loop defining a second target area for the passing or kicking of a football by one of the individuals utilizing said device, said target loop being mountable to said cross bar within said first target area; and an arm element attaching said target loop to said cross bar and including a second coupling mechanism for both variably adjusting the distance between said target loop and said cross bar within said first target area as well as for selectively adjusting the position of said target loop along said cross bar between said upright members.

20. The device as claimed in claim 19, wherein said first coupling mechanism comprises a device having a plurality of apertures disposed along the length of said cross bar, a plurality of apertures disposed along the length of each of said vertical upright members, and a pair of removable attachment pins selectively interchangeable with an aperture of each said upright member and an aperture of said cross bar.

21. The device as claimed in claim 19, wherein said second coupling mechanism comprises a device having a plurality of apertures disposed along the length of said cross bar, an elongated attachment pin projecting from said arm element and adaptable for engagement with one said cross bar aperture, and a plurality of compression clips disposed along the length of said attachment pin.

22. The device as claimed in claim 19, wherein said vertical upright members selectively project above said cross bar to further define said first target area.

23. The device as claimed in claim 19, wherein said cross bar and each said vertical upright member comprises a tubular element, each said upright being in the form of a pair of tubular elements telescopically interconnected to enable variable length adjustment thereof to vary the size and shape of said first target area.

24. The device as claimed in claim 19, wherein said target loop comprises an annular member disposed above said cross bar and defining an enclosed target opening for the passage of said footballs, and wherein said second coupling mechanism further provides angular adjustment of the plane defined by said second target area relative to the plane defined by said cross bar and said upright members to vary the angle of attack of a football passing through said second target area.

25. The device as claimed in claim 19, wherein said device further comprises a target assembly having a support structure and a netting carried by said support structure for receiving a football passing through said target area, said target assembly being selectively movable and attachable to a ground surface to provide diverse football passing and kicking activity for individuals utilizing said device.

26. The device as claimed in claim 25, wherein the support structure of said target assembly is adjustable in height and width to provide a selectively variable target window, the netting carried by said adjustable support structure being of sufficient size and shape to cover the variable sized target window.

* * * * *